US011845600B2

(12) United States Patent
Snyder et al.

(10) Patent No.: US 11,845,600 B2
(45) Date of Patent: Dec. 19, 2023

(54) INFLATABLE PACKAGING MATERIAL WITH NON-CONTINUOUS LONGITUDINAL CHANNELS

(71) Applicant: Sealed Air Corporation (US), Charlotte, NC (US)

(72) Inventors: William A. Snyder, Charlotte, NC (US); Jessica L. Denson, Fort Mill, SC (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 17/638,286

(22) PCT Filed: Aug. 27, 2020

(86) PCT No.: PCT/US2020/048074
§ 371 (c)(1),
(2) Date: Feb. 25, 2022

(87) PCT Pub. No.: WO2021/041589
PCT Pub. Date: Mar. 4, 2021

(65) Prior Publication Data

US 2022/0297914 A1 Sep. 22, 2022

Related U.S. Application Data

(60) Provisional application No. 62/892,617, filed on Aug. 28, 2019.

(51) Int. Cl.
*B65D 81/05* (2006.01)
*B65D 81/03* (2006.01)

(52) U.S. Cl.
CPC ..... *B65D 81/03* (2013.01)

(58) Field of Classification Search
CPC ..... B65D 81/03; B65D 81/022; B65D 81/02; B65D 81/05; B65D 81/052; B65D 31/14;
(Continued)

(56) References Cited

U.S. PATENT DOCUMENTS 3,142,599 A 7/1964 Chavannes
3,208,898 A 9/1965 Chavannes
(Continued)

FOREIGN PATENT DOCUMENTS

WO 0242066 A1 5/2002

*Primary Examiner* — King M Chu
(74) *Attorney, Agent, or Firm* — Jon M. Isaacson

(57) ABSTRACT

An inflatable web includes two juxtaposed sheets, seals between the sheets that define chambers, and two longitudinal edges. The chambers extend in a transverse direction between the two longitudinal edges. The seals include side seals that extend between the two longitudinal edges. The side seals include a two intermittent side seals and a continuous side seal. Each of the intermittent side seals includes side seal portions and gaps between the side seal portions. The gaps permit gas to pass between chambers on either side of the intermittent side seals. The continuous side seal is located between the two intermittent side seals. The continuous side seal does not permit gas to pass between chambers on either side of the continuous side seal. The gaps in the two intermittent side seals are aligned a longitudinal direction to form a non-continuous longitudinal channel across the continuous side seal.

21 Claims, 12 Drawing Sheets

(58) Field of Classification Search
CPC ..... A45C 13/021; A45C 13/02; A45C 7/0081; A45C 7/004
USPC ..... 206/522, 521, 591, 594; 383/3
See application file for complete search history.

(56) References Cited

U.S. PATENT DOCUMENTS 3,285,793 A 11/1966 Chavannes
3,508,992 A 4/1970 Chavannes
3,586,565 A 6/1971 Fielding
3,616,155 A 10/1971 Chavannes
3,660,189 A 5/1972 Troy
4,181,548 A 1/1980 Weingarten
4,184,904 A 1/1980 Gaffney
4,415,398 A 11/1983 Ottaviano
4,576,669 A 3/1986 Caputo
4,579,516 A 4/1986 Caputo
5,762,198 A * 6/1998 Hung ..... B65D 81/052 383/3
6,761,960 B2 7/2004 De Luca et al.
6,800,162 B2 10/2004 Kannankeril et al.
6,982,113 B2 1/2006 Kannankeril et al.
7,018,495 B2 3/2006 Kannankeril et al.
7,165,375 B2 1/2007 O'Dowd
7,220,476 B2 5/2007 Sperry et al.
7,223,461 B2 5/2007 Kannankeril et al.
7,429,304 B2 9/2008 McNamara et al.
7,694,820 B2 * 4/2010 Liao ..... B65D 81/052 383/44
7,721,781 B2 5/2010 Sperry et al.
7,807,253 B2 * 10/2010 Kannankeril ..... B29C 66/83415 428/188
7,938,264 B2 * 5/2011 Yoshifusa ..... B65D 81/052 383/3
7,950,433 B2 5/2011 Sperry et al.
8,360,641 B2 * 1/2013 Kim ..... B65D 81/03 383/44
9,969,136 B2 5/2018 Lepine et al.
10,286,617 B2 5/2019 Murch et al.
2006/0251833 A1 * 11/2006 Gavin ..... B32B 27/08 428/34.1
2015/0291335 A1 * 10/2015 Wetsch ..... B65D 81/052 428/12

* cited by examiner

INFLATABLE PACKAGING MATERIAL WITH NON-CONTINUOUS LONGITUDINAL CHANNELS

BACKGROUND

The present disclosure is in the technical field of inflatable webs. More particularly, the present disclosure is directed to inflatable webs with seals arranged to form non-continuous longitudinal channels when the inflatable webs are inflated.

Air cellular cushioning articles suitable for packaging applications have been in commercial use for several decades. One of the products in widespread use is Bubble-Wrap® cellular cushioning, one embodiment of which is made by using heat and vacuum to form spaced-apart, air-filled cavities in a first film and thereafter heat sealing a flat second "backing" film to the flats between the cavities of the first film, so that air is entrapped in the formed cavities making up the individualized cells. The resulting air-cellular cushioning product comprises discrete closed bubbles. If any one bubble bursts, no other bubble necessarily deflates. One significant disadvantage of BubbleWrap® cellular cushioning product is that shipping costs are high per unit weight of product because the product density is low (i.e., most of the volume such products is air).

Although Bubble Wrap® cushioning products have not been displaced by inflatable flexible cushioning articles, in the past there have been a number of commercialized air-cellular cushioning products for packaging which have been designed to be inflated by the end user, i.e., inflated and sealed shut immediately before end use by the packager. These products offer the advantage of being shippable before inflation, providing for much more efficient transport and storage before use, as any given volume within a truck or warehouse can hold over thirty times as much product if it is uninflated rather than shipped to the packager while inflated.

These "inflatable" cellular packaging products include inflatable sheets of air cellular material (e.g., U.S. Pat. No. 7,721,781, the contents of which are hereby incorporated by reference in their entirety), inflatable "pouches" of air cellular material (e.g., U.S. Pat. No. 9,969,136, the contents of which are hereby incorporated by reference in their entirety), and other forms of air cellular material. These inflatable cellular cushioning materials typically have a plurality of chambers extending from a fill zone, with each of the chambers containing a series of interconnected inflatable "cells" (e.g., inflatable "bubbles"), with each series of cells extending transversely across the web. Air within one of the cells of a particular series can freely move within other cells of the same series.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In a first embodiment, an inflatable web includes two juxtaposed sheets arranged such that the inflatable web comprises two longitudinal edges. The inflatable web also includes seals between the two juxtaposed sheets that define chambers. The chambers extend in a transverse direction between the two longitudinal edges. The seals include side seals that extend between the two longitudinal edges. The side seals include a first intermittent side seal, a second intermittent side seal, and a continuous side seal located between the first and second intermittent side seals. The first intermittent side seal includes first side seal portions and first gaps between the first side seal portions. The first gaps permit gas to pass between chambers on either side of the first intermittent side seal. The second intermittent side seal includes second side seal portions and second gaps between the second side seal portions. The second gaps permit gas to pass between chambers on either side of the second intermittent side seal. The continuous side seal does not permit gas to pass between chambers on either side of the continuous side seal. The first gaps are aligned with the second gaps in a longitudinal direction to form a non-continuous longitudinal channel across the continuous side seal.

In a second embodiment, the first intermittent side seal and the continuous side seal of the first embodiment form sides of a first chamber.

In a third embodiment, the first chamber of the second embodiment includes a plurality of cells that repeat in the transverse direction.

In a fourth embodiment, a shape of each of the plurality of cells in the third embodiment includes one or more of a circle, a rectangle, or a hexagon.

In a fifth embodiment, pairs of the plurality of cells of either of the third or fourth embodiments are coupled via passages.

In a sixth embodiment, a cell width of the first chamber of the fifth embodiment is a distance between the first intermittent side seal and the continuous side seal in one of the cells. A passage width of the first chamber is a distance between the first intermittent side seal and the continuous side seal in one of the passages.

In a seventh embodiment, the cell width of the sixth embodiment is a maximum width of the cells in the first chamber and the passage width is a minimum width of the passages between the cells in the first chamber.

In an eighth embodiment, the first gaps in the first intermittent side seal of either of the sixth or seventh embodiments have a transverse length that is greater than or equal to 75% of the cell width.

In a ninth embodiment, the first gaps in the first intermittent side seal of the eighth embodiment have a transverse length in a range between 15% less than the cell width and 15% greater than the cell width.

In a tenth embodiment, the transverse length of the first gaps in the first intermittent side seal of either of the eighth or ninth embodiments is less than or equal to 225% of the passage width.

In an eleventh embodiment, the transverse length of the first gaps in the first intermittent side seal of the tenth embodiment is less than or equal to 175% of the passage width.

In a twelfth embodiment, the first side seal portions in the first intermittent side seal of any of the sixth to eleventh embodiments have a transverse length that is greater than or equal to 25% of the passage width.

In a thirteenth embodiment, the first side seal portions in the first intermittent side seal of the twelfth embodiment have a transverse length that is greater than or equal to 75% of the passage width.

In a fourteenth embodiment, the transverse length of the first side seal portions in the first intermittent side seal of any of the twelfth to thirteenth embodiments is greater than or equal to 15% of the cell width.

In a fifteenth embodiment, the transverse length of the first side seal portions in the first intermittent side seal of the fourteenth embodiment is greater than or equal to 30% of the cell width.

In a sixteenth embodiment, the two longitudinal edges of the inflatable web of any of the second to fifteenth embodiments include a closed longitudinal edge. The first chamber includes a first distal end proximate the closed longitudinal edge.

In a seventieth embodiment, the first intermittent side seal of the sixteenth embodiment forms a side of a second chamber. Portions of the first and second chamber are located on opposite sides of the first intermittent side seal.

In an eighteenth embodiment, the second chamber of the seventeenth embodiment includes a second distal end proximate the closed longitudinal edge. A portion of the second distal end of the second chamber is located between the first distal end of the first chamber and the closed longitudinal edge such that the second distal end is part of a non-continuous distal longitudinal channel that extends across the continuous side seal.

In a nineteenth embodiment, the side seals of any of the preceding embodiments have an alternating pattern of continuous side seals and intermittent side seal such that a pair of consecutive side seals in the inflatable web includes one continuous side seal and one intermittent side seal.

In a twentieth embodiment, in the pair of consecutive side seals of the nineteenth embodiment, side seal portions of the one intermittent side seal have a substantially mirrored shape of corresponding portions of the one continuous side seal.

In a twenty first embodiment, at least two of the first side seal portions any of the preceding embodiments have different shapes.

In a twenty second embodiment, at least two of the first side seal portions any of the preceding embodiments have the same shape.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

In some examples herein, inflated panels formed from inflatable webs are cushion material is referred to as air cellular material. As used herein, the term "air cellular material" herein can refer to bubble cushioning material, such as BUBBLE WRAP® air cushioning material sold by Sealed Air Corporation, where a first film or laminate is formed (e.g., thermoformed, embossed, calendared, or otherwise processed) to define a plurality of cavities and a second film or laminate is adhered to the first film or laminate in order to close the cavities. As used herein, the term "air cellular material" herein can refer to inflatable cushioning material, such as BUBBLE WRAP® IB air cushioning material sold by Sealed Air Corporation or FILL-AIR® air pillows void fill material sold by Sealed Air Corporation, where an inflatable web can be inflated and sealed to form the air cellular material. Examples of air cellular materials are shown in U.S. Pat. Nos. 3,142,599, 3,208,898, 3,285,793, 3,508,992, 3,586,565, 3,616,155, 3,660,189, 4,181,548, 4,184,904, 4,415,398, 4,576,669, 4,579,516, 6,800,162, 6,982,113, 7,018,495, 7,165,375, 7,220,476, 7,223,461, 7,429,304, 7,721,781, 7,950,433, 9,969,136 and 10,286,617, the disclosures of which are hereby incorporated by reference in their entirety.

Figure 1B:
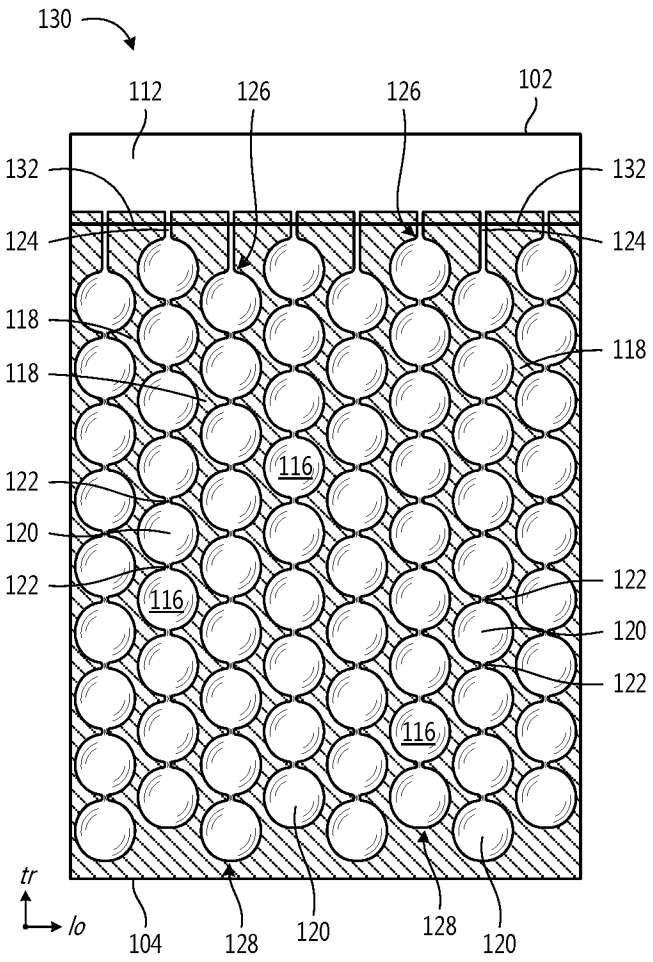
FIG. 1B depicts an embodiment of an inflated panel formed from the inflatable web shown in FIG. 1A, in accordance with the embodiments disclosed herein.
Figure 1A:
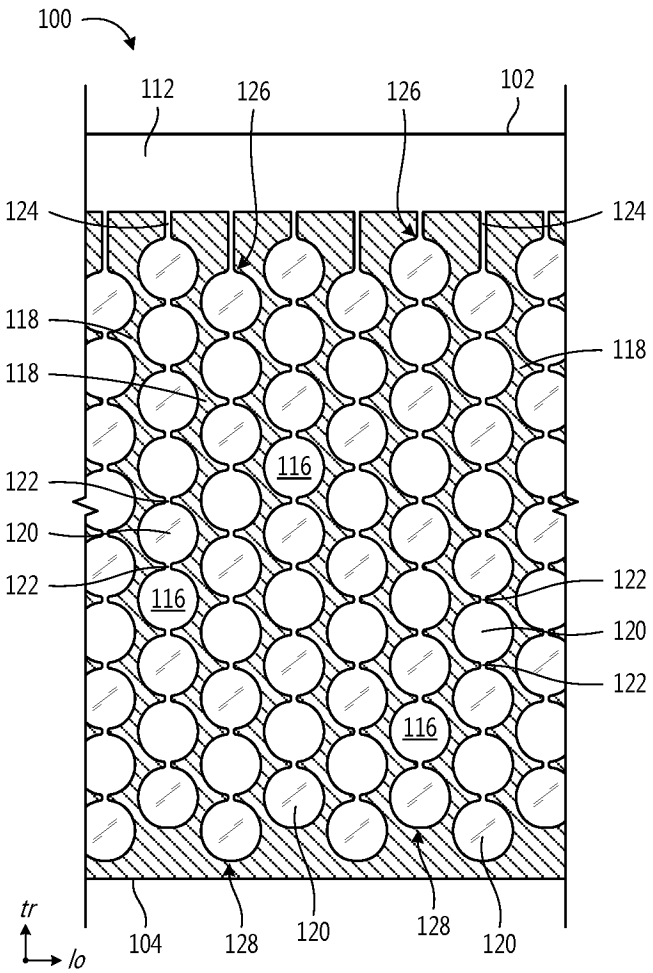
FIG. 1A depicts a front view of an embodiment of an inflatable web, in accordance with the embodiments disclosed herein.

FIG. 1A depicts a front view of an embodiment of an inflatable web 100. The inflatable web 100 includes two juxtaposed sheets that are arranged such that the inflatable web 100 includes a longitudinal edge 102 and a longitudinal edge 104. Inner surfaces of the two sheets are sealed to each other in a pattern that defined a series of chambers 116. In some embodiments, seals between the two sheets include seals 118 that define the chambers 116. In the depicted embodiment, the chambers 116 are shaped to have a series of cells 120 and passageways 122. In some embodiments, the cells 120 have a larger width than the passageways 122. In the depicted embodiment, the cells 120 have a generally circular shape such that, after the cells 120 are inflated, the cells 120 would have a three-dimensional "bubble" shape. In other embodiments, the cells 120 may have other shapes, such as rectangular shapes, hexagonal shapes, and the like. In the depicted embodiment, adjacent ones of the chambers 116 are offset from each other so that the cells 120 of one chamber are aligned with the passageways 122 of an adjacent chamber to enable the chambers 116 to be arranged in close proximity to each other.

In general, any of the sheets described herein may comprise any flexible material that can be manipulated to enclose a gas in inflatable chambers as herein described, including various thermoplastic materials, e.g., polyethylene homopolymer or copolymer, polypropylene homopolymer or copolymer, etc. Non-limiting examples of suitable thermoplastic polymers include polyethylene homopolymers, such as low density polyethylene (LDPE) and high density polyethylene (HDPE), and polyethylene copolymers such as, e.g., ionomers, EVA, EMA, heterogeneous (Zeigler-Natta catalyzed) ethylene/alpha-olefin copolymers, and homogeneous (metallocene, single-cite catalyzed) ethylene/alpha-olefin copolymers. Ethylene/alpha-olefin copolymers are copolymers of ethylene with one or more comonomers selected from C3 to C20 alpha-olefins, such as 1-butene, 1-pentene, 1-hexene, 1-octene, methyl pentene and the like, in which the polymer molecules comprise long chains with relatively few side chain branches, including linear low density polyethylene (LLDPE), linear medium density polyethylene (LMDPE), very low density polyethylene (VLDPE), and ultra-low density polyethylene (ULDPE). Various other materials are also suitable such as, e.g., polypropylene homopolymer or polypropylene copolymer (e.g., propylene/ethylene copolymer), polyesters, polystyrenes, polyamides, polycarbonates, etc. The film may be monolayer or multilayer and can be made by any known coextrusion process by melting the component polymer(s) and extruding or coextruding them through one or more flat or annular dies.

In some embodiments, the seals 118 also define inflation ports 124. Each of the inflation ports 124 permits fluid, such as gas (e.g., air), to pass from an inflation channel 112 into one of the chambers 116. In some embodiments, the inflation channel 112 is "open" because the two sheets are not connected at the longitudinal edge 102. When the inflation channel 112 is open, the inflation channel 112 can be positioned such that, as the inflatable web 100 is fed, a nozzle passes through the inflation channel 112 between the two sheets. In some embodiments, the inflation channel 112 is "closed" because the two sheets are connected at the longitudinal edge 102. When the inflation channel 112 is closed, the inflation channel 112 can be positioned such that, as the inflatable web 100 is fed, a nozzle is inserted into the inflation channel 112 between the two sheets and then the inflation channel 112 is slit open to permit the two sheets to pass on other side of the nozzle. Whether the inflation channel 112 is open or closed, the nozzle can inflate the chambers 116 inserting air into the inflation channel 112 that passes through the inflation ports 124 and into the chambers 116.

In some embodiments, the chambers 116 extend in a transverse direction between the two longitudinal edges 102 and 104. In the depictions shown herein, the transverse directions on inflatable webs and inflated webs are generally indicated by the arrow tr and the longitudinal directions on inflatable webs and inflated webs are generally indicated by the arrow lo. Generally, the longitudinal direction of an inflatable web is substantially parallel to the longitudinal edges 102 and 104 and the transverse direction of the inflatable web is substantially perpendicular to the longitudinal direction. In the depicted embodiment, the chambers 116 have proximal ends 126 and distal ends 128. The proximal ends 126 are the end of the chambers 116 that is closest to the longitudinal edge 102 and/or closest to the inflation channel 112. The distal ends 128 are the end of the chambers 116 that are closest to the longitudinal edge 104. In the depicted embodiment, the distal ends 128 of the chambers 116 are closed. In other embodiments, the distal ends 128 may be in fluid communication with another inflation chamber located along the longitudinal edge 104.

FIG. 1B depicts an embodiment of an inflated panel 130 formed from the inflatable web 100. The inflated panel 130 was formed by inflating some of the chambers 116 of the inflatable web 100, forming a seal 132 across the inflation ports 124 of the chambers 116, and cutting the sheets in the transverse direction tr to cut the inflated panel 130 from the inflatable web 100. The inflated panel 130 can be used as cushioning material and/or void fill material. For example, the inflated panel 130 can be placed in a shipping container to cushion a product in the shipping container and/or fill a void between the object and the walls of the shipping container.

Figure 2C:
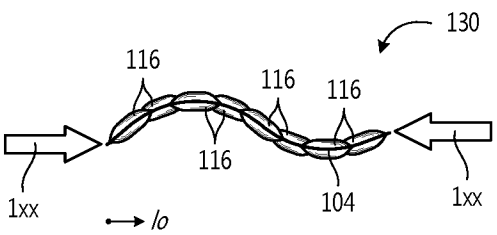
FIGS. 2A, 2B, and 2C depict front, side, and bottom views, respectively, of the inflated panel shown in FIG. 1B with compressive forces applied to the inflated panel, in accordance with the embodiments disclosed herein.
Figure 2B:
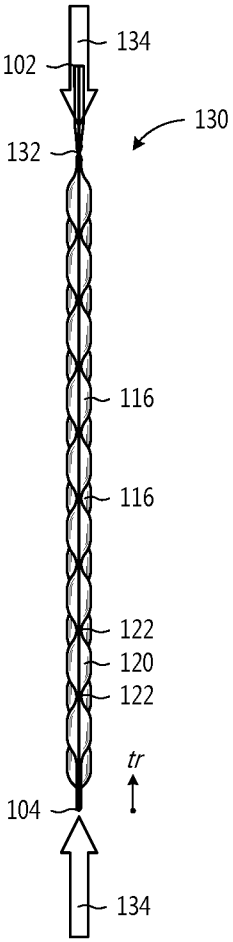
Figure 2A:
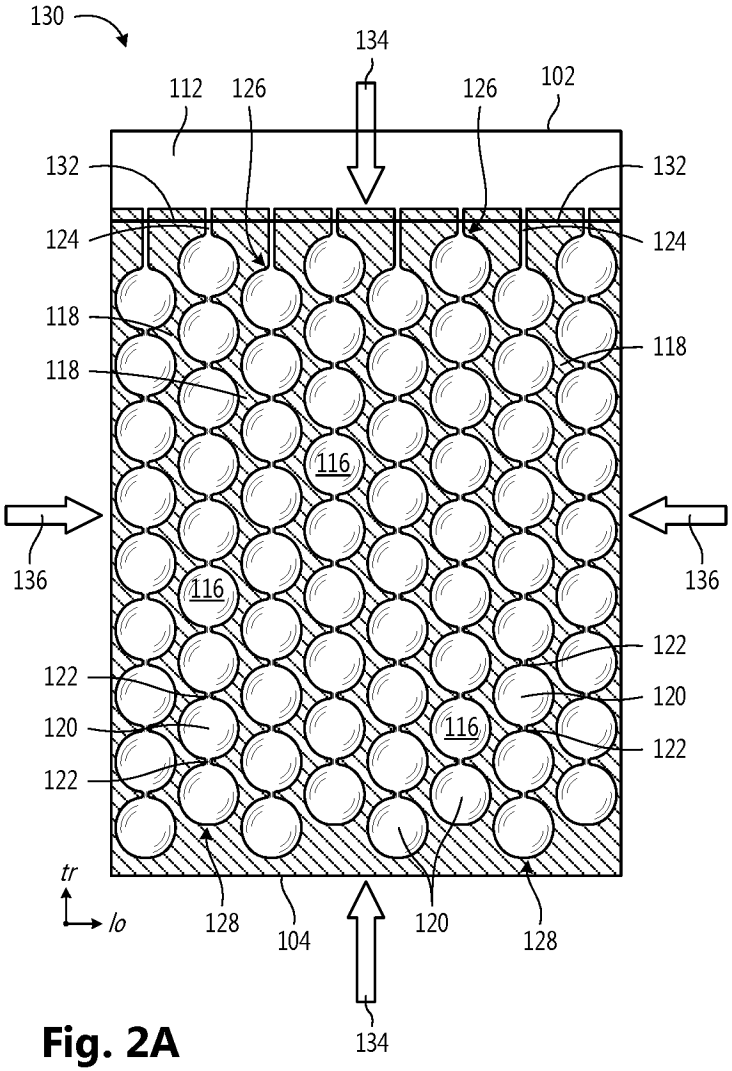

FIGS. 2A, 2B, and 2C depict front, side, and bottom views, respectively, of the inflated panel 130 with compressive forces applied to the inflated panel 130. In the depicted example, a compressive transverse force 134 is applied in the transverse direction tr and a compressive longitudinal force 136 is applied in the longitudinal direction lo. As can be seen in FIG. 2B, the inflated panel 130 resists deformation (e.g., folding) due to the compressive transverse force 134 in the transverse direction tr. The ability to resist deformation in the transverse direction tr is due at least in part to the continuous nature of the inflated chambers 116 in the transverse direction tr. For example, the presence of the inflated passageways 122 between the cells 120 in the transverse direction tr deters any folding of the inflated panel 130 between consecutive cells 120 in the same chamber 116. In contrast, as can be seen in FIG. 2C, the inflated panel 130 does not resist deformation due to the compressive longitudinal force 136 in the longitudinal direction lo. More specifically, the inflated panel 130 tends to fold between the chambers 116 (or "curl") when subjected to the compressive longitudinal force 136.

In some embodiments, it may be advantageous for the inflated panel 130 to be able to curl. For example, when the inflated panel 130 is used as cushioning material for a curved object (e.g., a wine bottle, a jar candle, etc.), it may be advantageous for the inflated panel 130 to curl around the object. However, in other circumstances, it may not be advantageous for the inflated panel 130 to curl. For example, when the inflated panel 130 is placed against the inner surface of a shipping box, the inflated panel 130 is intended to maintain a substantially planar shape to protect the entire inner surface of the shipping box. However, if the inflated panel 130 is able to curl, the inflated panel 130 may not maintain a substantially planar shape for the duration of its intended use in the substantially planar shape. If the inflated panel 130 curls in that situation, the inflated panel 130 no longer provides the cushioning effect that is desired. Thus, in some embodiments, it would be advantageous for the inflated panel 130 to resist any deformation in both the transverse and longitudinal directions.

Figure 3:
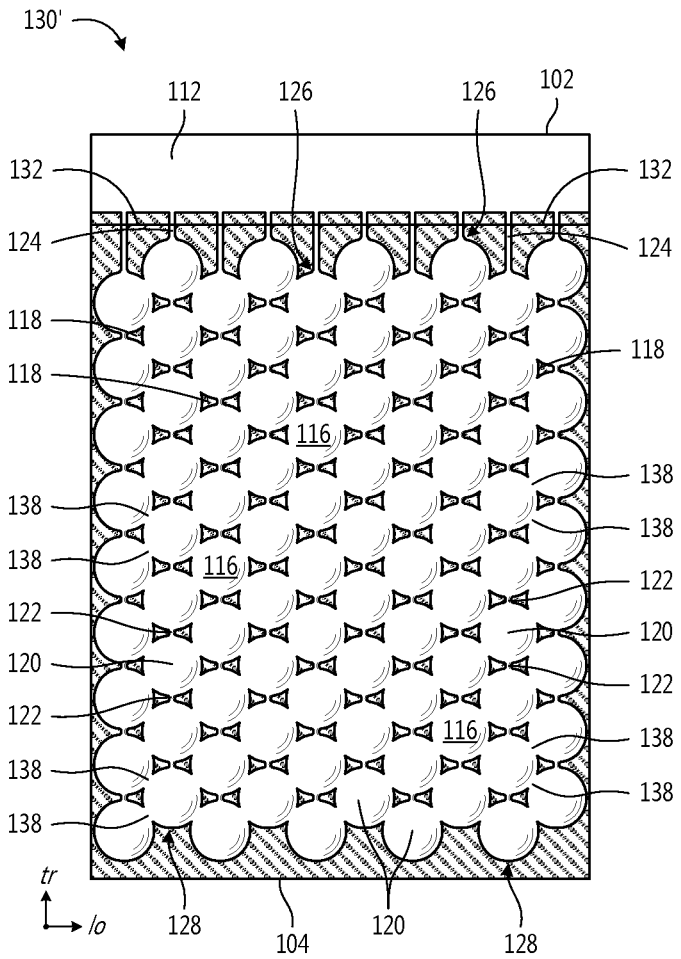
FIG. 3 depicts another embodiment of an inflated panel that is a variation of the inflatable panel shown in FIG. 3B and is capable of resisting deformation due to longitudinal compressive forces, in accordance with the embodiments disclosed herein.

FIG. 3 depicts another embodiment of an inflated panel 130' that is a variation of the inflatable panel 130 and is capable of resisting deformation due to longitudinal compressive forces. The inflated panel 130' is similar to the inflatable panel 130 except that the chambers 116 of the inflated panel 130' are interconnected with the neighboring chambers 116. More specifically, secondary passageways 138 exist between the cells 120 of one the chambers 116 and the cells 120 of a neighboring one of the chambers 116. The secondary passageways 138 permit gas to pass between neighboring chambers 116. In the depicted embodiment, all of the chambers 116 in the inflated panel 130' are interconnected. This arrangement of the chambers 116 may cause the inflated panel 130' to resist deformation (e.g., folding) due to a compressive longitudinal force in the longitudinal direction lo. The ability to resist deformation in the longitudinal direction lo is due at least in part to the continuous nature of the neighboring chambers 116 in the longitudinal direction lo. For example, the presence of the inflated secondary passageways 138 between the cells 120 in the longitudinal direction lo deters any folding of the inflated panel 130' between neighboring chambers 116.

While the inflated panel 130' may resist folding due to a compressive longitudinal force in the longitudinal direction lo, the interconnectedness of all of the chambers 116 in the inflated panel 130' is a significant drawback. More specifically, if any one of the cells 120 or chambers 116 ruptures, the entire inflated panel 130' will deflate and not provide any cushioning. If such a deflation were to happen at an inopportune moment, such as in the middle of shipment, the deflation of the inflated panel 130' can result in damage to the object for which the inflated panel 130' is intended to provide cushioning. It would be advantageous for an inflatable web to be arranged to provide semi-rigidity in both transverse and longitudinal directions while the chambers of the inflatable web are not all interconnected.

In some embodiments disclosed herein, the seals in inflatable webs form non-continuous longitudinal channels that provide semi-rigidity in the longitudinal direction. In some embodiments, an inflatable web includes chambers that are bounded by side seals, where some of the side seals are continuous side seals and some of the side seals are intermittent side seals. For example, the side seals may include a repeating pattern of continuous side seals and intermittent side seals so that every other side seal is a continuous side seal. The intermittent side seals include seal portions and gaps between the seal portions. In some embodiments, the gaps in intermittent side seals on either side of a continuous side seal are aligned in a longitudinal direction to form a non-continuous longitudinal channel across the continuous side seal. After inflation of the inflatable web into an inflated panel, the non-continuous longitudinal channel increases the rigidity of the inflated panel in the longitudinal direction.

Figure 4A:
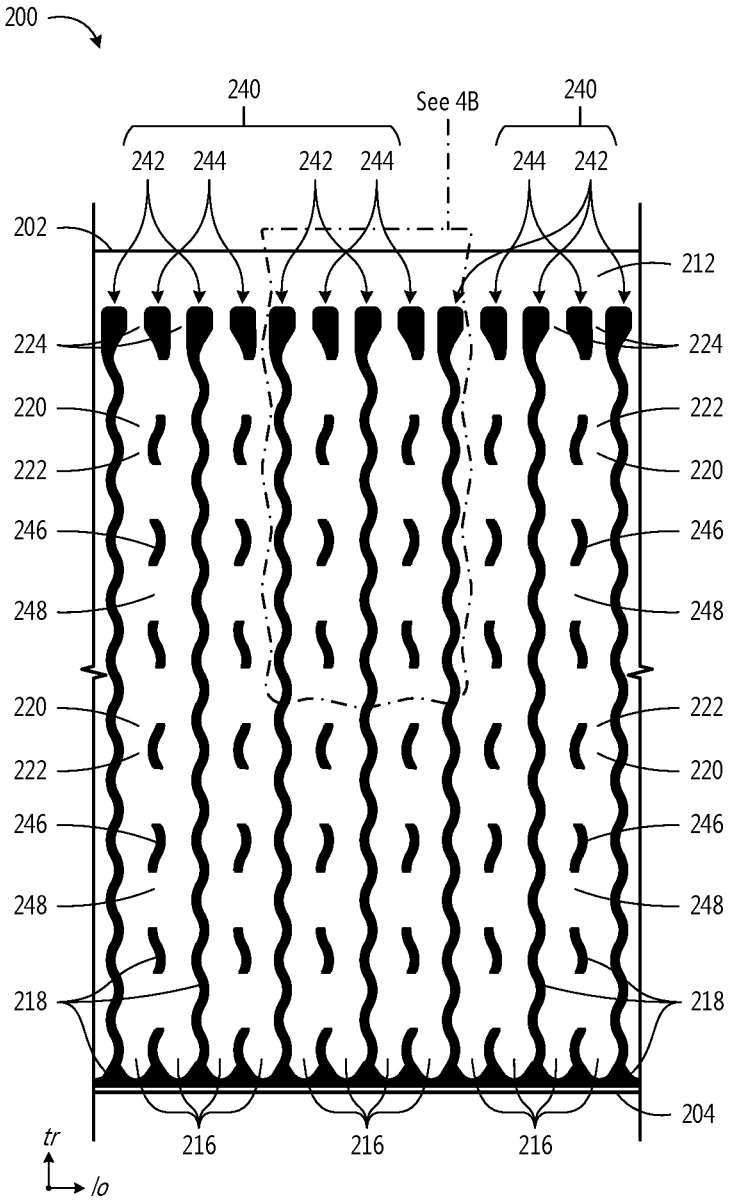
FIGS. 4A and 4B depict front and front detail views, respectively, of an embodiment of an inflatable web, in accordance with the embodiments disclosed herein.
Figure 4B:
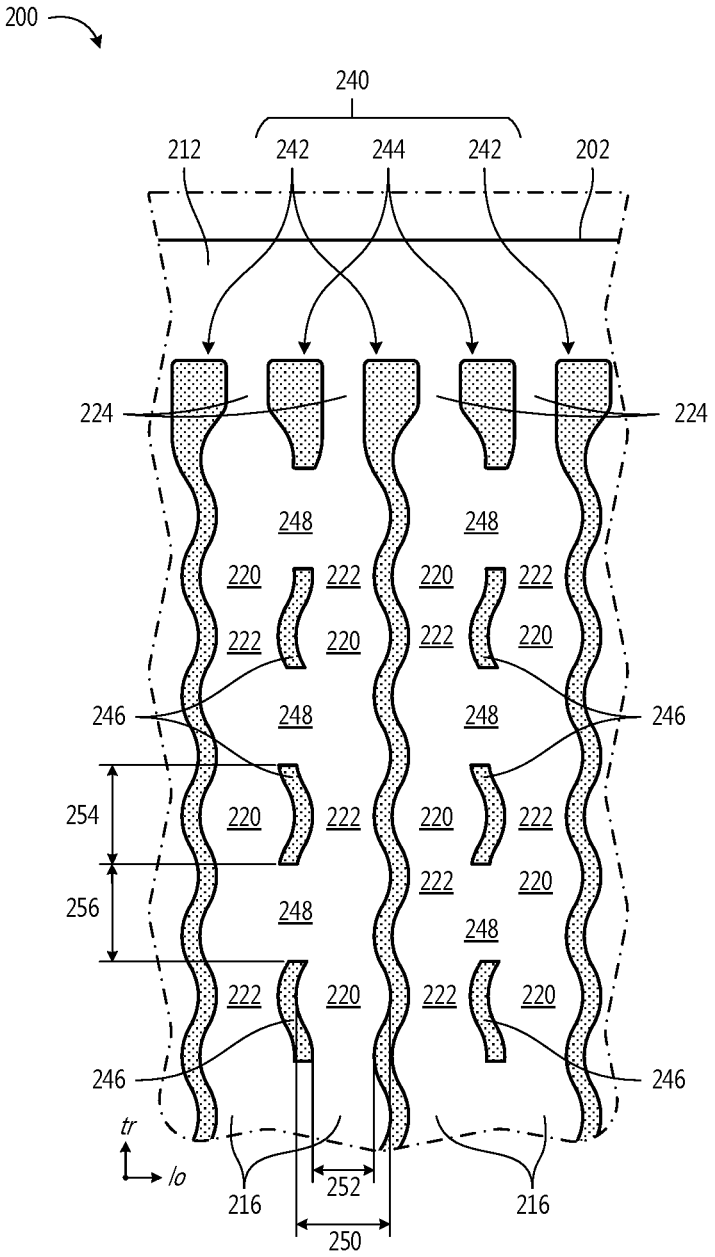

FIGS. 4A and 4B depict front and front detail views, respectively, of an embodiment of an inflatable web 200. The inflatable web 200 includes two juxtaposed sheets that are arranged such that the inflatable web 200 includes a longitudinal edge 202 and a longitudinal edge 204. Inner surfaces of the two sheets are sealed to each other in a pattern that defined a series of chambers 216. In some embodiments, seals between the two sheets include seals 218 that define the chambers 216. In the depicted embodiment, the chambers 216 are shaped to have a series of cells 220 and passageways 222. In some embodiments, the cells 220 have a larger width than the passageways 222. In the depicted embodiment, the cells 220 have a generally circular shape such that, after the cells 220 are inflated, the cells 220 would have a three-dimensional "bubble" shape. In other embodiments, the cells 220 may have other shapes, such as rectangular shapes, hexagonal shapes, and the like. In the depicted embodiment, adjacent ones of the chambers 216 are offset from each other so that the cells 220 of one chamber are aligned with the passageways 222 of an adjacent chamber to enable the chambers 216 to be arranged in close proximity to each other.

In some embodiments, the seals 218 also define inflation ports 224. Each of the inflation ports 224 permits fluid, such as gas (e.g., air), to pass from an inflation channel 212 into one of the chambers 216. In some embodiments, the inflation channel 212 is either an open inflation channel or a closed inflation channel. Whether the inflation channel 212 is open or closed, the nozzle can inflate the chambers 216 by inserting air into the inflation channel 212 that passes through the inflation ports 224 and into the chambers 216. In the depicted embodiment, the chambers 216 extend in a transverse direction tr between the two longitudinal edges 202 and 204. In the depicted embodiment, the chambers 216 have proximal ends and distal ends. The proximal ends are the ends of the chambers 216 that are closest to the longitudinal edge 202 and/or closest to the inflation channel 212. The distal ends are the ends of the chambers 216 that are closest to the longitudinal edge 204. In the depicted embodiment, the distal ends of the chambers 216 are closed.

In the depicted embodiment, the seals 218 include side seals 240 that extend between the extend between the longitudinal edges 202 and 204. The side seals 240 define sides of the chambers 216. The side seals 240 include continuous side seals 242 and intermittent side seals 244. The continuous side seals 242 do not permit gas to pass between the chambers 216 on either side of the continuous side seals 242. In the depicted embodiment, the continuous side seals 242 extends continuously from the proximal ends of the adjacent chambers 216 to the distal ends of the adjacent chambers 216. The intermittent side seals 244 include side seal portions 246 and gaps 248 between the side seal portions 246. In some embodiments, the side seal portions 246 have a substantially mirrored shape of corresponding portions of the one of the adjacent continuous side seals 242. The gaps 248 in the intermittent side seals 244 permit the gas to pass between the chambers 216 on either side of the intermittent side seals 244. In the depicted embodiment, at least two of the side seal portions 246 in one of the intermittent side seals 244 have a different shape.

As can be seen in FIG. 4B, the chambers 216 have a cell width 250. In some embodiments, the cell width 250 of one of the chambers 216 is a maximum width of the cells 220 in the chamber. The chambers 216 also have a passage width 252. In some embodiments, the passage width 252 of one of the chambers 216 is a minimum width of the passageways 222 in the chamber. The side seal portions 246 of the intermittent side seals 244 have a transverse length 254. The gaps 248 between the side seal portions 246 have a transverse length 256.

Figure 4C:
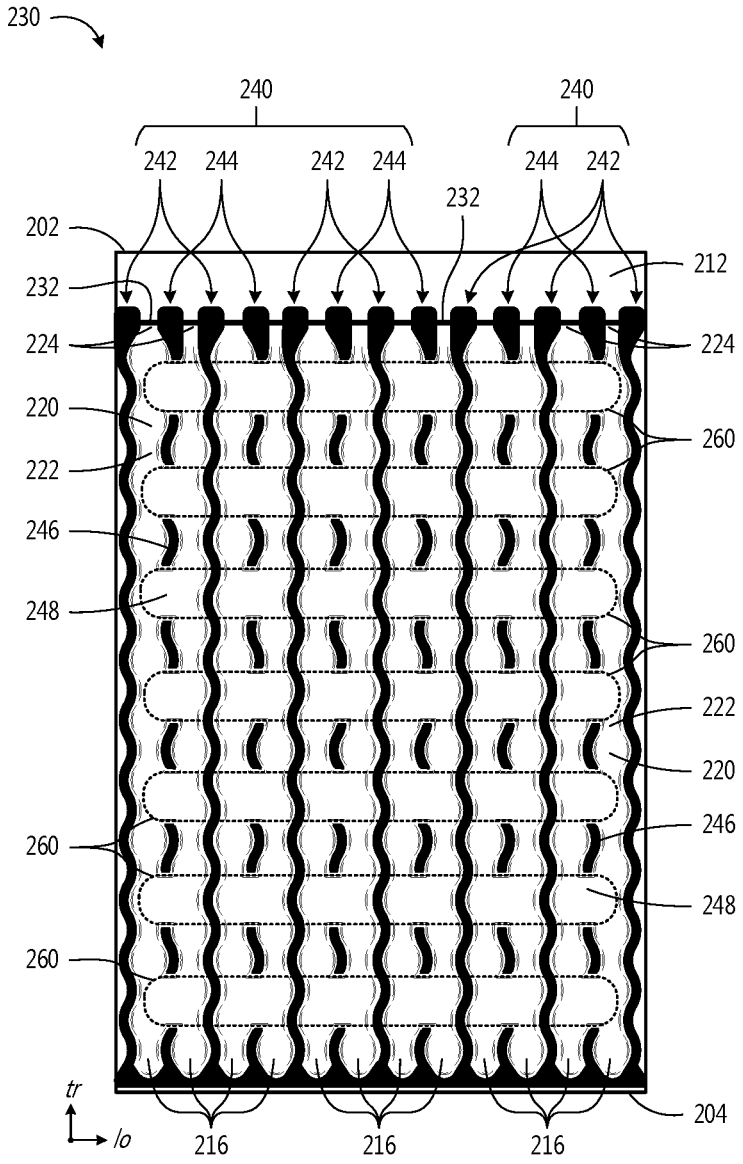
FIG. 4C depicts a front view an embodiment of an inflated panel formed from the inflatable web shown in FIGS. 4A and 4B, in accordance with the embodiments disclosed herein.

FIG. 4C depicts a front view an embodiment of an inflated panel 230 formed from the inflatable web 200. In FIG. 4C, the chambers 216 have been inflated and a seal 232 has been formed across the inflation ports 224 to close the chambers 216. Because every pair of consecutive side seals 240 in the inflated panel includes one continuous side seal 242 and one intermittent side seal 244, no more than two of the chambers 216 are fluidly coupled together. Thus, any rupture in one of the cells 220 or the passageways 222 will not deflate more than two of the chambers 216. In the depicted embodiment, the gaps 248 in the intermittent side seals 244 are aligned in the longitudinal direction lo. The result of this alignment of the gaps 248 in the inflated panel 230 is a number of non-continuous longitudinal channel 260. The non-continuous longitudinal channels 260 extend in the longitudinal direction lo across the continuous side seals 242. While these non-continuous longitudinal channels 260 are not fluidly coupled through the continuous side seals 242, the non-continuous longitudinal channels 260 are fluidly coupled through the gaps 248 in the intermittent side seals 244. This arrangement provides the benefit of increased rigidity in the longitudinal direction lo while reducing the number of chambers 216 that would deflate in the event of a rupture in one of the cells 220 or the passageways 222.

The characteristics of the inflatable web may influence the effectiveness of the non-continuous longitudinal channels 260. In some embodiments, the transverse length 256 of the gaps 248 in the intermittent side seals 244 is greater than or equal to 75% of the cell width 250. Optionally, the transverse length 256 of the gaps 248 in the intermittent side seals 244 is in a range between 15% less than the cell width 250 and 15% greater than the cell width 250. In some embodiments, the transverse length 256 of the gaps 248 in the intermittent side seals 244 is less than or equal to 225% of the passage width 252. Optionally, the transverse length 256 of the gaps 248 in the intermittent side seals 244 is less than or equal to 175% of the passage width 252. In some embodiments, the transverse length 254 of the side seal portions 246 in the intermittent side seals 244 is greater than or equal to 25% of the passage width 252. Optionally, the transverse length 254 of the side seal portions 246 in the intermittent side seals 244 is greater than or equal to 75% of the passage width 252. In some embodiments, the transverse length 254 of the side seal portions 246 in the intermittent side seals 244 is greater than or equal to 15% of the cell width 250. Optionally, the transverse length 254 of the side seal portions 246 in the intermittent side seals 244 is greater than or equal to 30% of the cell width 250.

In the inflatable web 200, the shapes of the side seal portions 246 have a substantially mirrored shape of corresponding portions of one of the adjacent continuous side seals 242. However, in any one of the intermittent side seals 244, the shapes of the side seal portions 246 vary. The characteristics of the inflatable web 200 that will produce an effective non-continuous longitudinal channel—for example, the transverse length 254 of the side seal portions 246 or the transverse length 256 of the gaps 248 between the side seal portions 246—may result in the varying shapes of the side seal portions 246 shown in the inflatable web 200. In other embodiments, it may be effective and/or aesthetically desirable for the side seal portions in a given intermittent side seal to have the same shape.

Figure 5A:
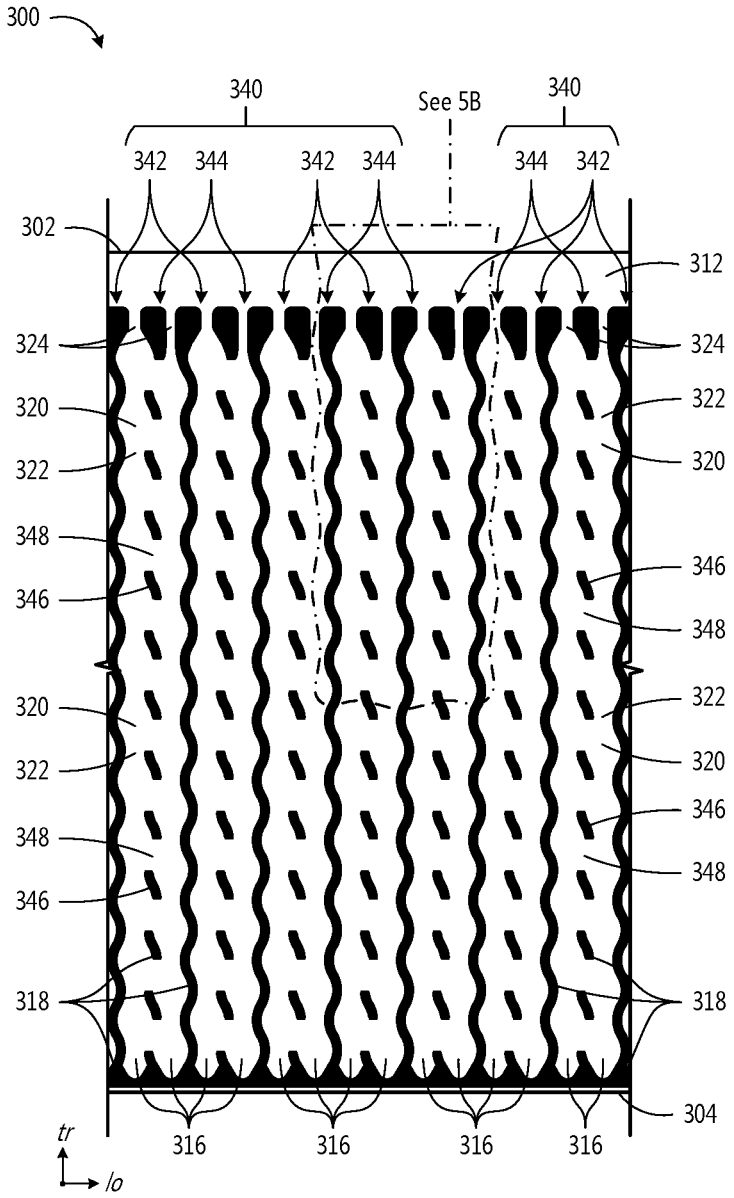
FIGS. 5A and 5B depict front and front detail views, respectively, of another embodiment of an inflatable web, in accordance with the embodiments disclosed herein.
Figure 5B:
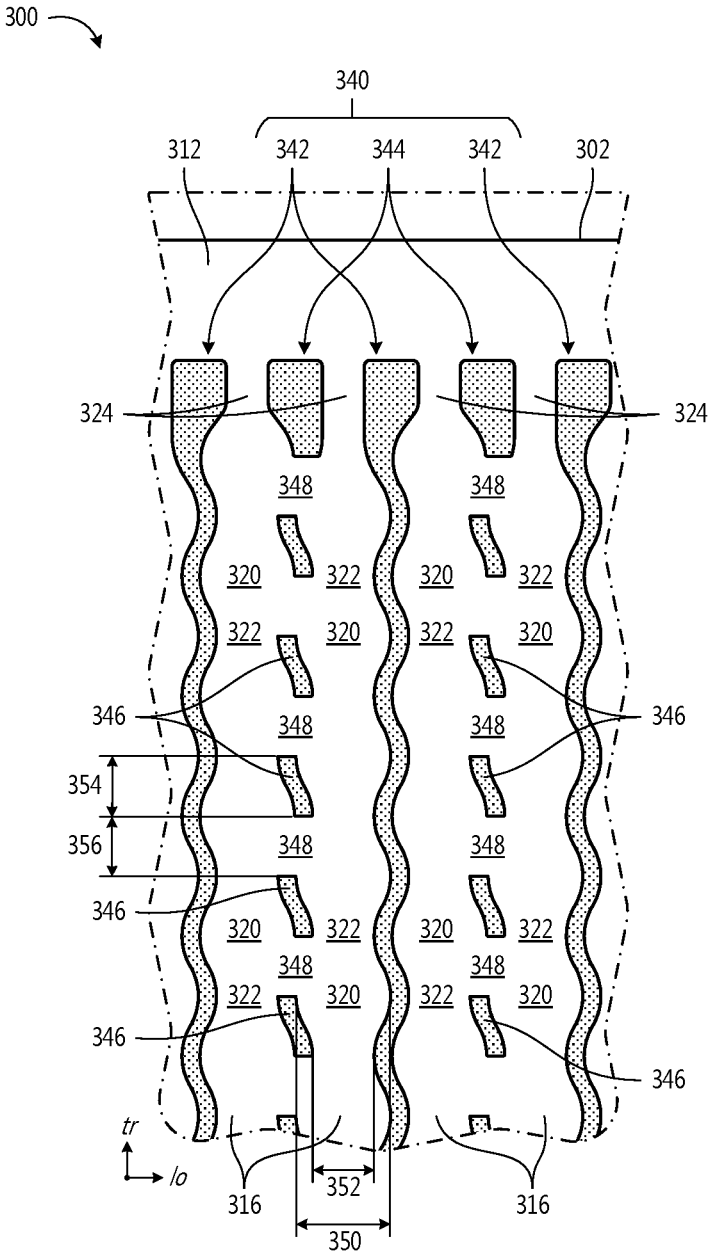

FIGS. 5A and 5B depict front and front detail views, respectively, of another embodiment of an inflatable web 300. The inflatable web 300 includes two juxtaposed sheets that are arranged such that the inflatable web 300 includes a longitudinal edge 302 and a longitudinal edge 304. Inner surfaces of the two sheets are sealed to each other in a pattern that defined a series of chambers 316. In some embodiments, seals between the two sheets include seals 318 that define the chambers 316. In the depicted embodiment, the chambers 316 are shaped to have a series of cells 320 and passageways 322. In some embodiments, the cells 320 have a larger width than the passageways 322. In the depicted embodiment, the cells 320 have a generally circular shape such that, after the cells 320 are inflated, the cells 320 would have a three-dimensional "bubble" shape. In other embodiments, the cells 320 may have other shapes, such as rectangular shapes, hexagonal shapes, and the like. In the depicted embodiment, adjacent ones of the chambers 316 are offset from each other so that the cells 320 of one chamber are aligned with the passageways 322 of an adjacent chamber to enable the chambers 316 to be arranged in close proximity to each other.

In some embodiments, the seals 318 also define inflation ports 324. Each of the inflation ports 324 permits fluid, such as gas (e.g., air), to pass from an inflation channel 312 into one of the chambers 316. In some embodiments, the inflation channel 312 is either an open inflation channel or a closed inflation channel. Whether the inflation channel 312 is open or closed, the nozzle can inflate the chambers 316 by inserting air into the inflation channel 312 that passes through the inflation ports 324 and into the chambers 316. In the depicted embodiment, the chambers 316 extend in a transverse direction tr between the two longitudinal edges 302 and 304. In the depicted embodiment, the chambers 316 have proximal ends and distal ends. The proximal ends are the ends of the chambers 316 that are closest to the longitudinal edge 302 and/or closest to the inflation channel 312. The distal ends are the ends of the chambers 316 that are closest to the longitudinal edge 304. In the depicted embodiment, the distal ends of the chambers 316 are closed.

In the depicted embodiment, the seals 318 include side seals 340 that extend between the extend between the longitudinal edges 302 and 304. The side seals 340 define sides of the chambers 316. The side seals 340 include continuous side seals 342 and intermittent side seals 344. The continuous side seals 342 do not permit gas to pass between the chambers 316 on either side of the continuous side seals 342. In the depicted embodiment, the continuous side seals 342 extends continuously from the proximal ends of the adjacent chambers 316 to the distal ends of the adjacent chambers 316. The intermittent side seals 344 include side seal portions 346 and gaps 348 between the side seal portions 346. In some embodiments, the side seal portions 346 have a substantially mirrored shape of corresponding portions of the one of the adjacent continuous side seals 342. The gaps 348 in the intermittent side seals 344 permit the gas to pass between the chambers 316 on either side of the intermittent side seals 344. In the depicted embodiment, at least two of the side seal portions 346 in one of the intermittent side seals 344 have the same shape.

As can be seen in FIG. 5B, the chambers 316 have a cell width 350. In some embodiments, the cell width 350 of one of the chambers 316 is a maximum width of the cells 320 in the chamber. The chambers 316 also have a passage width 352. In some embodiments, the passage width 352 of one of the chambers 316 is a minimum width of the passageways 322 in the chamber. The side seal portions 346 of the intermittent side seals 344 have a transverse length 354. The gaps 348 between the side seal portions 346 have a transverse length 356.

Figure 5C:
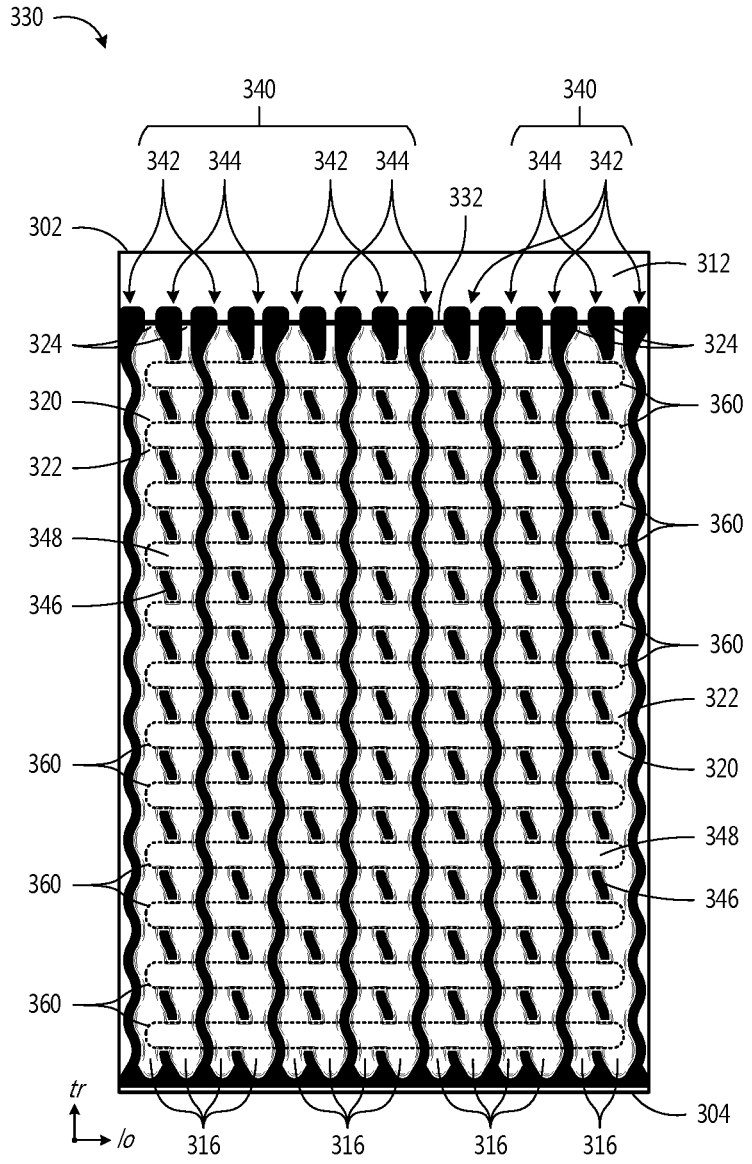
FIG. 5C depicts a front view an embodiment of an inflated panel formed from the inflatable web shown in FIGS. 5A and 5B, in accordance with the embodiments disclosed herein.

FIG. 5C depicts a front view of an embodiment of an inflated panel 330 formed from the inflatable web 300. In FIG. 5C, the chambers 316 have been inflated and a seal 332 has been formed across the inflation ports 324 to close the chambers 316. Because every pair of consecutive side seals 340 in the inflated panel includes one continuous side seal 342 and one intermittent side seal 344, no more than two of the chambers 316 are fluidly coupled together. Thus, any rupture in one of the cells 320 or the passageways 322 will not deflate more than two of the chambers 316. In the depicted embodiment, the gaps 348 in the intermittent side seals 344 are aligned in the longitudinal direction lo. The result of this alignment of the gaps 348 in the inflated panel 330 is a number of non-continuous longitudinal channel 360. The non-continuous longitudinal channels 360 extend in the longitudinal direction lo across the continuous side seals 342. While these non-continuous longitudinal channels 360 are not fluidly coupled through the continuous side seals 342, the non-continuous longitudinal channels 360 are fluidly coupled through the gaps 348 in the intermittent side seals 344. This arrangement provides the benefit of increased rigidity in the longitudinal direction lo while reducing the number of chambers 316 that would deflate in the event of a rupture in one of the cells 320 or the passageways 322.

The characteristics of the inflatable web may influence the effectiveness of the non-continuous longitudinal channels 360. In some embodiments, the transverse length 356 of the gaps 348 in the intermittent side seals 344 is greater than or equal to 75% of the cell width 350. Optionally, the transverse length 356 of the gaps 348 in the intermittent side seals 344 is in a range between 15% less than the cell width 350 and 15% greater than the cell width 350. In some embodiments, the transverse length 356 of the gaps 348 in the intermittent side seals 344 is less than or equal to 325% of the passage width 352. Optionally, the transverse length 356 of the gaps 348 in the intermittent side seals 344 is less than or equal to 175% of the passage width 352. In some embodiments, the transverse length 354 of the side seal portions 346 in the intermittent side seals 344 is greater than or equal to 35% of the passage width 352. Optionally, the transverse length 354 of the side seal portions 346 in the intermittent side seals 344 is greater than or equal to 75% of the passage width 352. In some embodiments, the transverse length 354 of the side seal portions 346 in the intermittent side seals 344 is greater than or equal to 15% of the cell width 350. Optionally, the transverse length 354 of the side seal portions 346 in the intermittent side seals 344 is greater than or equal to 30% of the cell width 350.

As can be seen in FIGS. 4C and 5C, the non-continuous longitudinal channels 260 and 360 can be somewhat spaced away from the longitudinal edges 204 and 304, respectively, of the inflated panels 230 and 330. This spacing may be advantageous under certain circumstances, such as when the longitudinal edge of an inflated panel may need to be bent along the inside of a corner of a shipping container. In other situations, it may be advantageous for a non-continuous longitudinal channel to be located as close as possible to the longitudinal edge of an inflated panel to provide increased rigidity of the inflated panel near the longitudinal edge.

Figure 6A:
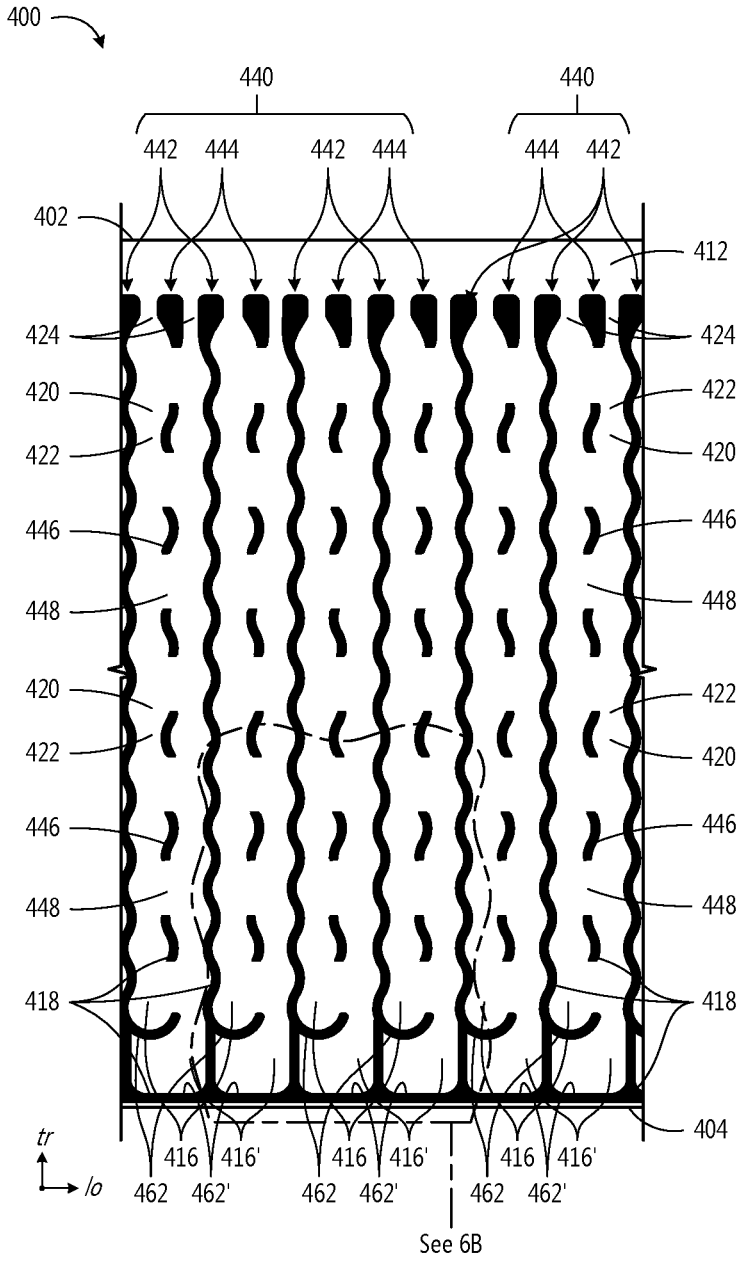
FIGS. 6A and 6B depict front and front detail views, respectively, of another embodiment of an inflatable web, in accordance with the embodiments disclosed herein.
Figure 6B:
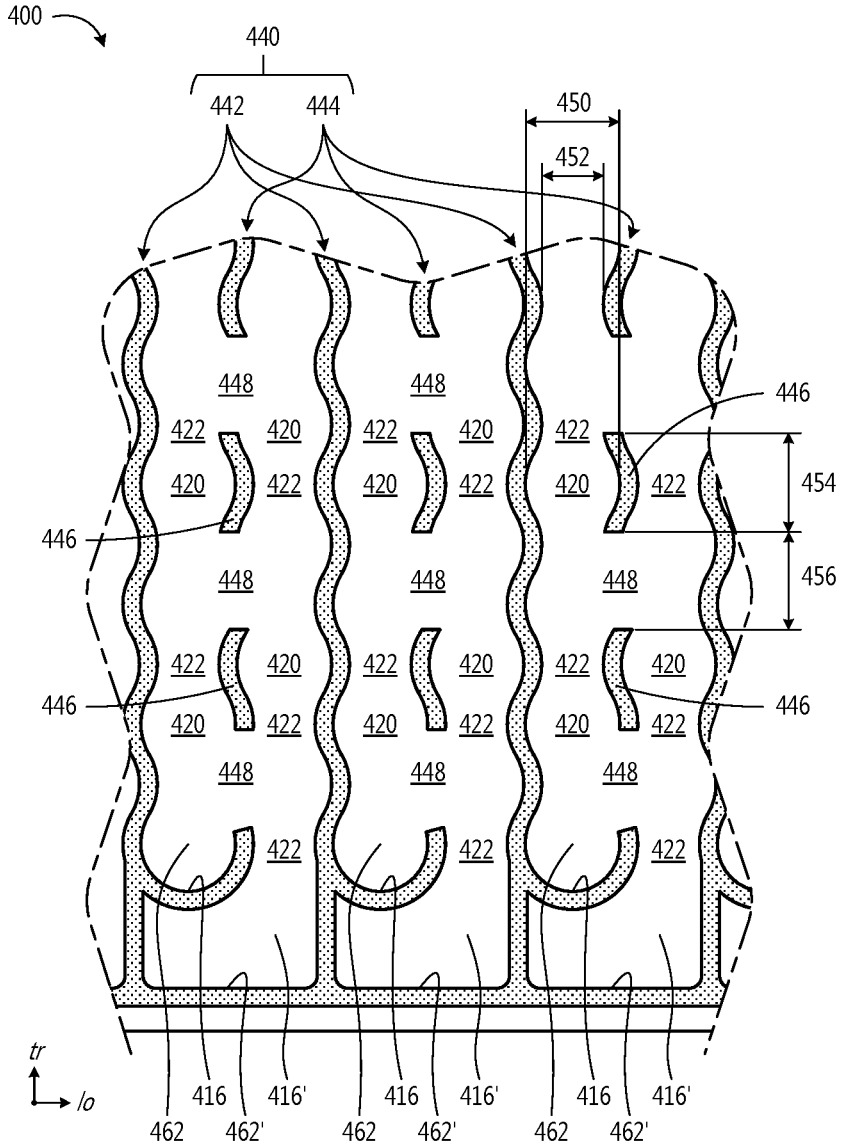

FIGS. 6A and 6B depict front and front detail views, respectively, of another embodiment of an inflatable web 400. The inflatable web 400 includes two juxtaposed sheets that are arranged such that the inflatable web 400 includes a longitudinal edge 402 and a longitudinal edge 404. Inner surfaces of the two sheets are sealed to each other in a pattern that defined a series of chambers 416 and 416'. In some embodiments, seals between the two sheets include seals 418 that define the chambers 416 and 416'. In the depicted embodiment, the chambers 416 and 416' are shaped to have a series of cells 420 and passageways 422. In some embodiments, the cells 420 have a larger width than the passageways 422. In the depicted embodiment, the cells 420 have a generally circular shape such that, after the cells 420 are inflated, the cells 420 would have a three-dimensional "bubble" shape. In other embodiments, the cells 420 may have other shapes, such as rectangular shapes, hexagonal shapes, and the like. In the depicted embodiment, adjacent ones of the chambers 416 and 416' are offset from each other so that the cells 420 of one chamber are aligned with the passageways 422 of an adjacent chamber to enable the chambers 416 and 416' to be arranged in close proximity to each other.

In some embodiments, the seals 418 also define inflation ports 424. Each of the inflation ports 424 permits fluid, such as gas (e.g., air), to pass from an inflation channel 412 into one of the chambers 416 and 416'. In some embodiments, the inflation channel 412 is either an open inflation channel or a closed inflation channel. Whether the inflation channel 412 is open or closed, the nozzle can inflate the chambers 416 by inserting air into the inflation channel 412 that passes through the inflation ports 424 and into the chambers 416 and 416'. In the depicted embodiment, the chambers 416 and 416' extend in a transverse direction tr between the two longitudinal edges 402 and 404. In the depicted embodiment, the chambers 416 and 416' have proximal ends and distal ends. The proximal ends are the ends of the chambers 416 that are closest to the longitudinal edge 402 and/or closest to the inflation channel 412. The chambers 416 have distal ends 462 and the chambers 416' have distal ends 462'. The distal ends 462 and 462' of the chambers 416 and 416' are the ends of the chambers 416 and 416' closest to the longitudinal edge 404. In the depicted embodiment, the distal ends 462 and 462' of the chambers 416 and 416' are closed.

In the depicted embodiment, the seals 418 include side seals 440 that extend between the extend between the longitudinal edges 402 and 404. The side seals 440 define sides of the chambers 416 and 416'. The side seals 440 include continuous side seals 442 and intermittent side seals 444. The continuous side seals 442 do not permit gas to pass between the chambers 416 on either side of the continuous side seals 442. In the depicted embodiment, the continuous side seals 442 extends continuously from the proximal ends of the adjacent chambers 416 and 416' to the distal ends of the adjacent chambers 416 and 416'. The intermittent side seals 444 include side seal portions 446 and gaps 448 between the side seal portions 446. In some embodiments, the side seal portions 446 have a substantially mirrored shape of corresponding portions of the one of the adjacent continuous side seals 442. The gaps 448 in the intermittent side seals 444 permit the gas to pass between the chambers 416 and 416' on either side of the intermittent side seals 444. In the depicted embodiment, at least two of the side seal portions 446 in one of the intermittent side seals 444 have a different shape.

As can be seen in FIG. 6B, the chambers and 416' have a cell width 450. In some embodiments, the cell width 450 of one of the chambers and 416' is a maximum width of the cells 420 in the chamber. The chambers and 416' also have a passage width 452. In some embodiments, the passage width 452 of one of the chambers and 416' is a minimum width of the passageways 422 in the chamber. The side seal portions 446 of the intermittent side seals 444 have a transverse length 454. The gaps 448 between the side seal portions 446 have a transverse length 456.

In the depicted embodiment, the each of the chambers 416 is bounded on the left side by one of the continuous side seals 442 and on the right by one of the intermittent side seals 444. Similarly, each of the chambers 416' is bounded on the left by one of the intermittent side seals 444 and on the right side by one of the continuous side seals 442. The distal ends 462' of the chambers 416' are located proximate the longitudinal edge 404. A portion of each of the distal ends 462' of the chambers 416' is located between one of the distal ends 462 of the chambers 416. As described in greater detail below, this arrangement allows the distal ends 462 and 462' to be part of a non-continuous distal longitudinal channel that extends across the continuous side seals 442.

Figure 6C:
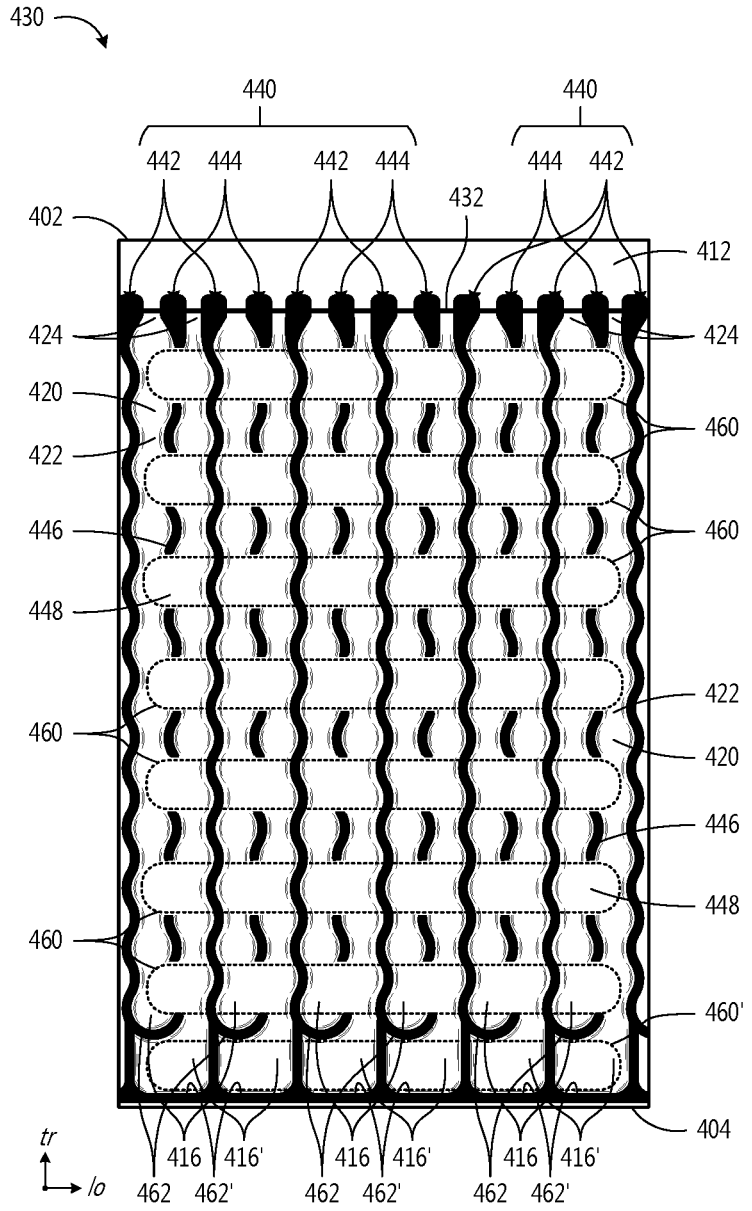
FIG. 6C depicts a front view an embodiment of an inflated panel formed from the inflatable web shown in FIGS. 5A and 5B, in accordance with the embodiments disclosed herein.

FIG. 6C depicts a front view of an embodiment of an inflated panel 430 formed from the inflatable web 400. In FIG. 6C, the chambers 416 have been inflated and a seal 432 has been formed across the inflation ports 424 to close the chambers 416. Because every pair of consecutive side seals 440 in the inflated panel includes one continuous side seal 442 and one intermittent side seal 444, no more than two of the chambers 416 are fluidly coupled together. Thus, any rupture in one of the cells 420 or the passageways 422 will not deflate more than two of the chambers 416. In the depicted embodiment, the gaps 448 in the intermittent side seals 444 are aligned in the longitudinal direction lo. The result of this alignment of the gaps 448 in the inflated panel 430 is a number of non-continuous longitudinal channel 460. The non-continuous longitudinal channels 460 extend in the longitudinal direction lo across the continuous side seals 442. While these non-continuous longitudinal channels 460 are not fluidly coupled through the continuous side seals 442, the non-continuous longitudinal channels 460 are fluidly coupled through the gaps 448 in the intermittent side seals 444. This arrangement provides the benefit of increased rigidity in the longitudinal direction lo while reducing the number of chambers 416 that would deflate in the event of a rupture in one of the cells 420 or the passageways 422. The portions of the chamber 416' near the longitudinal edge 404 also form a non-continuous distal longitudinal channel 460' between the distal ends 462 of the chambers 416 and the distal ends 462' and the chambers 462'. The non-continuous distal longitudinal channel 460' extends in the longitudinal direction lo across the continuous side seals 442. The non-continuous distal longitudinal channel 460' provides additional rigidity in the longitudinal direction lo to the inflated panel 430 near the longitudinal edge 404.

The characteristics of the inflatable web may influence the effectiveness of the non-continuous longitudinal channels 460. In some embodiments, the transverse length 456 of the gaps 448 in the intermittent side seals 444 is greater than or equal to 75% of the cell width 450. Optionally, the transverse length 456 of the gaps 448 in the intermittent side seals 444 is in a range between 15% less than the cell width 450 and 15% greater than the cell width 450. In some embodiments, the transverse length 456 of the gaps 448 in the intermittent side seals 444 is less than or equal to 425% of the passage width 452. Optionally, the transverse length 456 of the gaps 448 in the intermittent side seals 444 is less than or equal to 175% of the passage width 452. In some embodiments, the transverse length 454 of the side seal portions 446 in the intermittent side seals 444 is greater than or equal to 45% of the passage width 452. Optionally, the transverse length 454 of the side seal portions 446 in the intermittent side seals 444 is greater than or equal to 75% of the passage width 452. In some embodiments, the transverse length 454 of the side seal portions 446 in the intermittent side seals 444 is greater than or equal to 15% of the cell width 450. Optionally, the transverse length 454 of the side seal portions 446 in the intermittent side seals 444 is greater than or equal to 30% of the cell width 450.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. An inflatable web, comprising:

two juxtaposed sheets arranged such that the inflatable web comprises two longitudinal edges; and seals between the two juxtaposed sheets that define chambers, wherein the chambers extend in a transverse direction between the two longitudinal edges, and wherein the seals include side seals that extend between the two longitudinal edges;

wherein the side seals include:

a first intermittent side seal comprising first side seal portions and first gaps between the first side seal portions, wherein the first gaps permit gas to pass between chambers on either side of the first intermittent side seal, a second intermittent side seal comprising second side seal portions and second gaps between the second side seal portions, wherein the second gaps permit gas to pass between chambers on either side of the second intermittent side seal, and a continuous side seal located between the first and second intermittent side seals, wherein the continuous side seal does not permit gas to pass between chambers on either side of the continuous side seal;

wherein the first gaps are aligned with the second gaps in a longitudinal direction to form a non-continuous longitudinal channel across the continuous side seal;

wherein the first intermittent side seal and the continuous side seal form sides of a first chamber;

wherein the first chamber includes a plurality of cells that repeat in the transverse direction;

wherein pairs of the plurality of cells are coupled via passages;

wherein a cell width of the first chamber is a distance between the first intermittent side seal and the continuous side seal in one of the cells, and wherein a passage width of the first chamber is a distance between the first intermittent side seal and the continuous side seal in one of the passages; and wherein the cell width is a maximum width of the cells in the first chamber, and wherein the passage width is a minimum width of the passages between the cells in the first chamber.

2. The inflatable web of claim 1, wherein the first gaps in the first intermittent side seal have a transverse length that is greater than or equal to 75% of the cell width.

3. The inflatable web of claim 2, wherein the first gaps in the first intermittent side seal have a transverse length in a range between 15% less than the cell width and 15% greater than the cell width.

4. The inflatable web of claim 2, wherein the transverse length of the first gaps in the first intermittent side seal is less than or equal to 225% of the passage width.

5. The inflatable web of claim 4, wherein the transverse length of the first gaps in the first intermittent side seal is less than or equal to 175% of the passage width.

6. The inflatable web of claim 1, wherein the first side seal portions in the first intermittent side seal have a transverse length that is greater than or equal to 25% of the passage width.

7. The inflatable web of claim 6, wherein the first side seal portions in the first intermittent side seal have a transverse length that is greater than or equal to 75% of the passage width.

8. The inflatable web of claim 6, wherein the transverse length of the first side seal portions in the first intermittent side seal is greater than or equal to 15% of the cell width.

9. The inflatable web of claim 8, wherein the transverse length of the first side seal portions in the first intermittent side seal is greater than or equal to 30% of the cell width.

10. The inflatable web of claim 1, wherein the side seals have an alternating pattern of continuous side seals and intermittent side seal such that a pair of consecutive side seals in the inflatable web includes one continuous side seal and one intermittent side seal.

11. The inflatable web of claim 10, wherein, in the pair of consecutive side seals, side seal portions of the one intermittent side seal have a substantially mirrored shape of corresponding portions of the one continuous side seal.

12. The inflatable web of claim 1, wherein at least two of the first side seal portions have different shapes.

13. The inflatable web of claim 1, wherein at least two of the first side seal portions have the same shape.

14. The inflatable web of claim 1, wherein a shape of each of the plurality of cells includes one or more of a circle, a rectangle, or a hexagon.

15. An inflatable web, comprising:

two juxtaposed sheets arranged such that the inflatable web comprises two longitudinal edges; and seals between the two juxtaposed sheets that define chambers, wherein the chambers extend in a transverse direction between the two longitudinal edges, and wherein the seals include side seals that extend between the two longitudinal edges;

wherein the side seals include:

a first intermittent side seal comprising first side seal portions and first gaps between the first side seal portions, wherein the first gaps permit gas to pass between chambers on either side of the first intermittent side seal, a second intermittent side seal comprising second side seal portions and second gaps between the second side seal portions, wherein the second gaps permit gas to pass between chambers on either side of the second intermittent side seal, and a continuous side seal located between the first and second intermittent side seals, wherein the continuous side seal does not permit gas to pass between chambers on either side of the continuous side seal;

wherein the first gaps are aligned with the second gaps in a longitudinal direction to form a non-continuous longitudinal channel across the continuous side seal;

wherein the first intermittent side seal and the continuous side seal form sides of a first chamber; and wherein the first intermittent side seal forms a side of a second chamber, and wherein portions of the first and second chamber are located on opposite sides of the first intermittent side seal.

16. The inflatable web of claim 15, wherein the second chamber includes a second distal end proximate the closed longitudinal edge, and wherein a portion of the second distal end of the second chamber is located between the first distal end of the first chamber and the closed longitudinal edge such that the second distal end is part of a non-continuous distal longitudinal channel that extends across the continuous side seal.

17. The inflatable web of claim 15, wherein the side seals have an alternating pattern of continuous side seals and intermittent side seal such that a pair of consecutive side seals in the inflatable web includes one continuous side seal and one intermittent side seal.

18. The inflatable web of claim 17, wherein, in the pair of consecutive side seals, side seal portions of the one intermittent side seal have a substantially mirrored shape of corresponding portions of the one continuous side seal.

19. The inflatable web of claim 15, wherein at least two of the first side seal portions have different shapes.

20. The inflatable web of claim 15, wherein at least two of the first side seal portions have the same shape.

21. The inflatable web of claim 15, wherein a shape of each of the plurality of cells includes one or more of a circle, a rectangle, or a hexagon.

* * * * *